US008653911B2

(12) United States Patent
Kim et al.

(10) Patent No.: US 8,653,911 B2
(45) Date of Patent: Feb. 18, 2014

(54) ATMOSPHERIC PLASMA EQUIPMENT AND WAVEGUIDE FOR THE SAME

(75) Inventors: Ik Nyeon Kim, Seoul (KR); Young Yeon Ji, Kyonggi-do (KR)

(73) Assignee: Triple Cores Korea, Gyeonggi-do (KR)

( * ) Notice: Subject to any disclaimer, the term of this patent is extended or adjusted under 35 U.S.C. 154(b) by 284 days.

(21) Appl. No.: 13/189,430

(22) Filed: Jul. 22, 2011

(65) Prior Publication Data

US 2013/0020939 A1 Jan. 24, 2013

(51) Int. Cl.
*H01P 3/12* (2006.01)

(52) U.S. Cl.
USPC ..... 333/239

(58) Field of Classification Search
USPC ..... 315/111.21, 111.71; 333/81 B, 239, 18 B
See application file for complete search history.

(56) References Cited

U.S. PATENT DOCUMENTS 5,276,386 A * 1/1994 Watanabe et al. ..... 315/111.21
5,785,807 A * 7/1998 Kanai et al. ..... 216/69
5,804,033 A * 9/1998 Kanai et al. ..... 216/69
5,914,051 A * 6/1999 Kanai et al. ..... 216/69

FOREIGN PATENT DOCUMENTS

KR 10-2008-0033408 4/2008

OTHER PUBLICATIONS

English Language Abstract of KR 10-2008-0033408.

* cited by examiner

*Primary Examiner* — Minh D A
(74) *Attorney, Agent, or Firm* — Rabin & Berdo, P.C.

(57) ABSTRACT

Provided is an atmospheric plasma equipment and a waveguide for the same. The atmospheric plasma equipment according to this disclosure includes: an oscillator supplying an electromagnetic wave; and a waveguide into which the electromagnetic wave generated from the oscillator is input to be propagated therethrough, wherein the waveguide includes at least one or more steps, and plasma is generated at a waveguide region including a final short portion. The atmospheric plasma equipment may simultaneously attain an effect of causing concentration of an electromagnetic wave applied through the waveguide with one or more steps and an effect of stably maintaining generated plasma.

14 Claims, 5 Drawing Sheets

ATMOSPHERIC PLASMA EQUIPMENT AND WAVEGUIDE FOR THE SAME

TECHNICAL FIELD

The following disclosure relates to an atmospheric plasma equipment and a waveguide for the same, and in particular, to an atmospheric plasma equipment capable of simultaneously attaining an effect of causing concentration of an electromagnetic wave applied through a waveguide with one or more steps and an effect of stably maintaining generated plasma and a waveguide for the same.

BACKGROUND

An existing plasma generating apparatus includes a waveguide propagating an electromagnetic wave therethrough, a 3-stub adjusting plasma impedance, and a plasma generating portion generating plasma, where a discharge tube is provided in the plasma generating portion. When an electromagnetic wave is propagated through the waveguide, the electric field concentrates on the plasma generating portion of the waveguide and plasma is generated therefrom.

Therefore, the waveguide is an important factor when designing a structure capable of effectively causing concentration of the electric field.

The structure of the waveguide has been developed to be gradually decreased in height from the existing rectangular flat structure.

FIG. 1 is an entire schematic diagram illustrating a plasma reactor disclosed in Korean Patent Application Laid-Open No. 10-2008-0033408 (hereinafter, referred to as a related art)

Referring to FIG. 1, the plasma reactor according to the related art has a tapered shape of which the height decreases by a predetermined angle so as to cause concentration of the electric field (the electromagnetic wave) applied from the waveguide, and the rear end of the waveguide is provided with a reactor chamber where plasma is generated with the application of the electric field. The related art discloses the tapered waveguide minimizing the amount of the reflected electromagnetic wave, but there is a problem in that the actual concentration effect of the electric field in the actual chamber generating plasma reduces compared to the rear end of the waveguide.

SUMMARY

The present disclosure is directed to providing a waveguide with a new structure capable of maximizing concentration of an electric field at relatively low power consumption and an atmospheric plasma equipment using the same.

In one general aspect, an atmospheric plasma equipment includes: an oscillator supplying an electromagnetic wave; and a waveguide into which the electromagnetic wave generated from the oscillator is input to be propagated therethrough, wherein the waveguide includes at least one or more steps, and plasma is generated at a waveguide region including a final short portion.

The short portion generating the plasma may be shorter than the first height of the waveguide into which the electromagnetic wave is input, and at least one of the steps of the waveguide may be realized in a tapered structure of which the height continuously decreases by a predetermined angle.

At least one of the steps of the waveguide may perpendicularly decrease in height, and the short portion may decrease in height to have a tapered structure.

The steps may be all realized by a tapered structure of which the height continuously decreases by a predetermined angle.

The waveguide may have a double tapered structure, and the tapered waveguide may include: a first tall portion with a predetermined height; a first tapered portion connected to the end of the first tall portion and decreasing in height by a predetermined angle; a second tall portion connected to the end of the first tapered portion; a second tapered portion connected to the end of the second tall portion; and a short portion connected to the end of the second tapered portion.

Plasma may be generated in the short portion, the second tapered portion, or the boundary region thereof, and the second tall portion may be taller than the end of the first tapered portion.

The length of the second tall portion may be a predetermined length or more or 0.

In another general aspect, a waveguide with a structure used in the atmospheric plasma equipment is provided.

Other features and aspects will be apparent from the following detailed description, the drawings, and the claims.

BRIEF DESCRIPTION OF THE DRAWINGS

The above and other objects, features and advantages of the present disclosure will become apparent from the following description of certain exemplary embodiments given in conjunction with the accompanying drawings, in which.

DETAILED DESCRIPTION OF EMBODIMENTS

Figure 1:
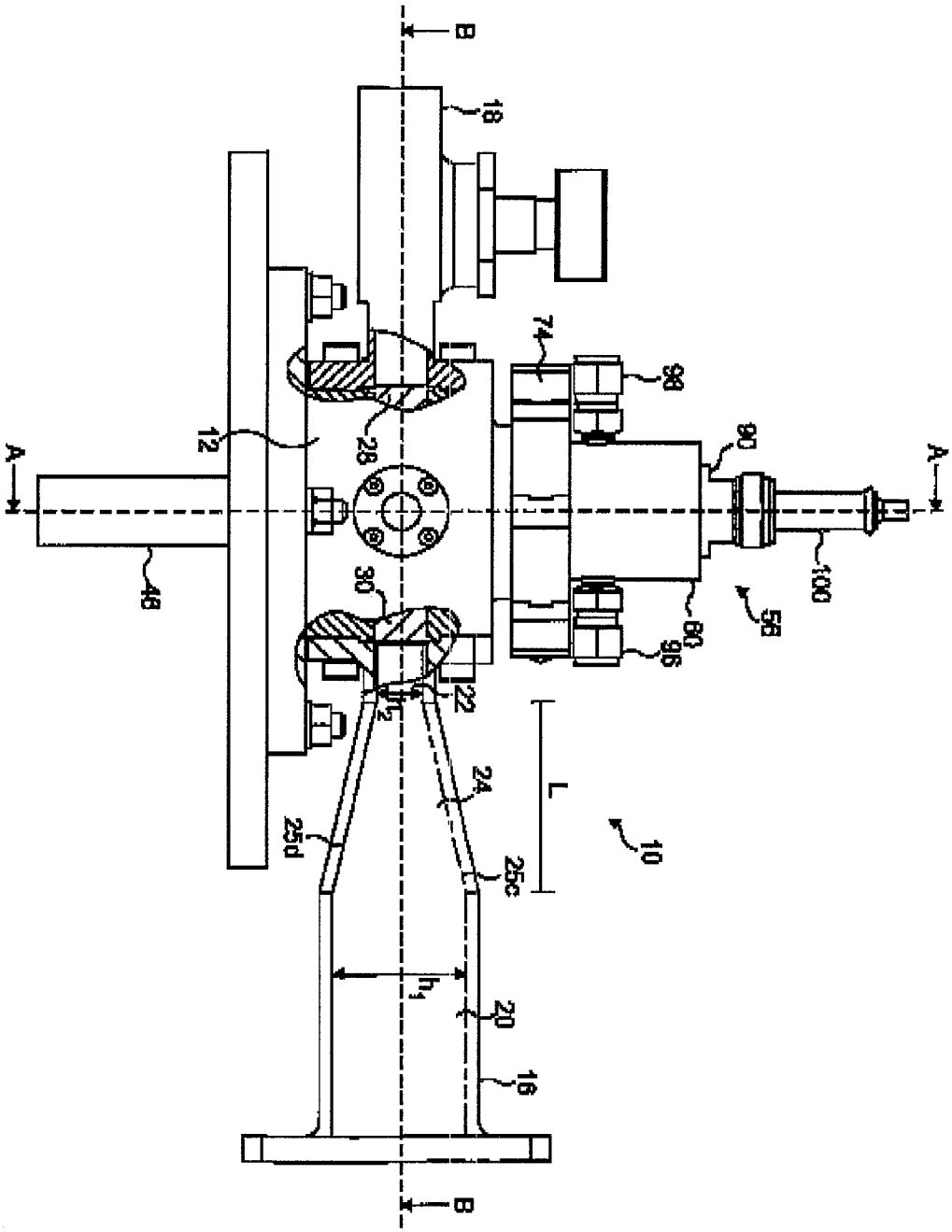
FIG. 1 is an entire schematic diagram illustrating a plasma reactor disclosed in Korean Patent Application Laid-Open No. 10-2008-0033408.

The advantages, features and aspects of the present disclosure will become apparent from the following description of the embodiments with reference to the accompanying drawings, which is set forth hereinafter. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. The terminology used herein is for the purpose of describing particular embodiments only and is not intended to be limiting of example embodiments. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Hereinafter, exemplary embodiments will be described in detail with reference to the accompanying drawings. The same reference numerals will be used for the same components on the drawings, and the same components will not be described again.

In the entire description of the specification, when it is described such that a certain part includes a certain component, unless a special remark is made, other components are not excluded, but may be further included therein. Further, the terminologies such as the "unit", the "group", the "module", and the "block" mentioned in the specification indicate the unit of performing at least one function or operation, and those may be realized by hardware, software, or the combination thereof.

This disclosure may simultaneously attain an effect of causing concentration of an electromagnetic wave applied through a waveguide with one or more steps and an effect of stably maintaining generated plasma.

Here, the height indicates the length in one direction of the waveguide to which an electromagnetic wave is applied, and the short portion indicates a region where the length is shortened so that the electromagnetic wave concentrates thereon.

The inventor found that the concentration effect of the electromagnetic wave was generated in the waveguide continuously or intermittently decreasing in height according to the related art, but the effect was not sufficiently large. In order to improve the effect, the inventor has made a structure in which at least one or more steps is provided in a waveguide to maximize the concentration effect of the electromagnetic wave by resonance, a short portion is formed at the end of the waveguide where the electromagnetic wave is finally reflected, and plasma is generated at a region including the short portion, so that the improved stability of the plasma is obtained as well as concentration of the electromagnetic wave. The step used in the specification indicates a technical configuration in which the height of the waveguide decreases and increases again, and the waveguide partially includes a short portion and a tall portion.

As a technical configuration, the waveguide according to one embodiment of this disclosure includes the end of the final waveguide shorter than the first waveguide, and at least one or more steps are provided therebetween. As described above, the step of the specification indicates a structure of which the height decreases and increases again.

Figure 2:
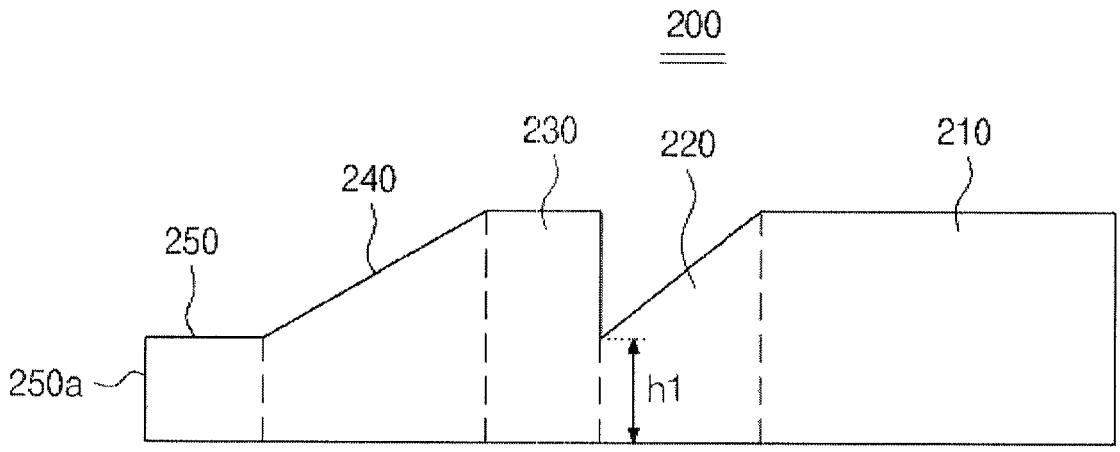
FIG. 2 is a cross-sectional view illustrating a waveguide according to one embodiment of this disclosure.

FIG. 2 is a cross-sectional view illustrating a waveguide according to one embodiment of this disclosure. However, the scope of this disclosure is not limited to the shape of the following waveguide.

Referring to FIG. 2, a waveguide 200 according to this disclosure is formed in a double tapered structure, and the waveguide 200 includes a first tall portion 210 to which an electromagnetic wave generated from an oscillator such as a magnetron is applied and a first tapered portion 220 which is connected to the end of the first tall portion 210 and decreases in height by a predetermined angle. The electromagnetic wave concentrates through the first tapered portion 220.

The rear end (here, the rear end indicates a rear end to which the electromagnetic wave is applied) of the first tapered portion 220 is provided with a second tall portion 230 having a parallel structure with a predetermined length, and the height of the waveguide decreases and increases again through the first tall portion, the tapered portion, and the second tall portion (generation of a step). Accordingly, the electromagnetic wave concentrating on the first tapered portion 220 generates a resonance effect in the second tall portion 230. In the existing waveguide of which the height decreases by a predetermined angle, when energy concentrates and is reflected, the energy is just reflected from one end of the waveguide to the other end thereof. However, in the waveguide according to this disclosure, the reflection is not permitted any more due to the second height decreasing portion (in FIG. 2, the rear end of the first tapered portion) when seen in the direction where the reflected energy is reflected. As a result, the electromagnetic wave more concentrates on the first height decreasing portion (within the first tapered portion) in the application direction. Therefore, the magnitude of the electric field changes in accordance with the position of the second height decreasing portion (the second tapered portion), and the electric field is stronger than that of the first height decreasing portion since a portion of a specific wavelength concentrates and disappears, so that the magnitude of the electric field increases as a whole. The height of the second tall portion may be variously set, but it is desirable that the height is taller than the height h1 of the rear end of the first tapered portion from the viewpoint of the resonance effect.

The rear end of the second tall portion 230 is provided with a second tapered portion 240, so that the electromagnetic wave passing through the second tall portion 230 concentrates again and the electromagnetic wave concentrates on a short portion 250 connected to the rear end of the second tapered portion 240. At this time, the electromagnetic wave reflected from a distal end 250*a* of the waveguide and the electromagnetic wave maximized after passing through two steps (the step between the first tall portion and the first tapered portion and the step between the second tall portion and the second tapered portion) concentrates and is maximized at the short portion 250.

Figure 3:
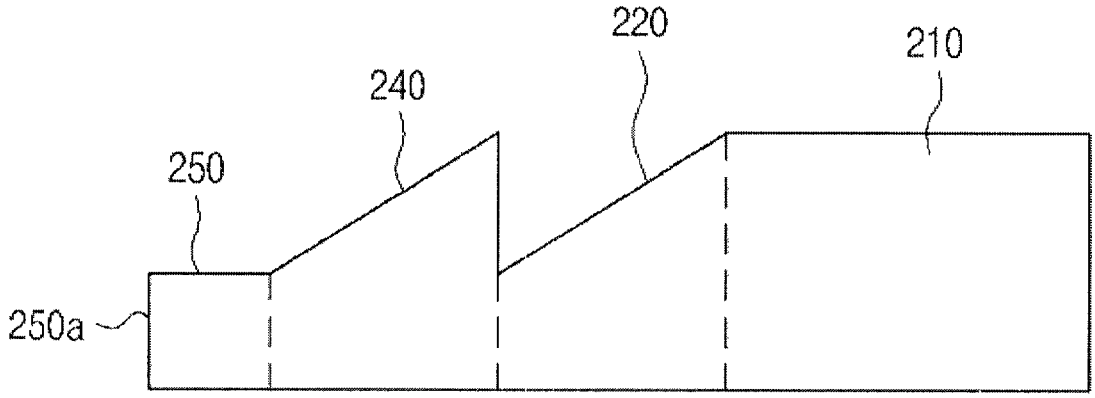
FIG. 3 is a cross-sectional view illustrating a waveguide according to another embodiment of this disclosure.

FIG. 3 is a cross-sectional view illustrating the waveguide according to another embodiment of this disclosure. The second tall portion does not have a predetermined length, and the waveguide has a continuous double tapered structure. That is, the waveguide includes the first tall portion 210 and the first tapered portion 220, and the end of the first tapered portion 220 is directly provided with the second tapered portion 240. That is, in the above-described configuration, the length of the second tall portion is 0, but one step (a configuration in which the height decreases and increases again) is formed as in FIG. 2.

In FIGS. 2 and 3, a technical configuration is disclosed in which the step of the waveguide is realized by a tapered structure, but a technical configuration may be provided in which the step is simply formed by decreasing the height perpendicularly instead of the tapered structure.

Figure 4:
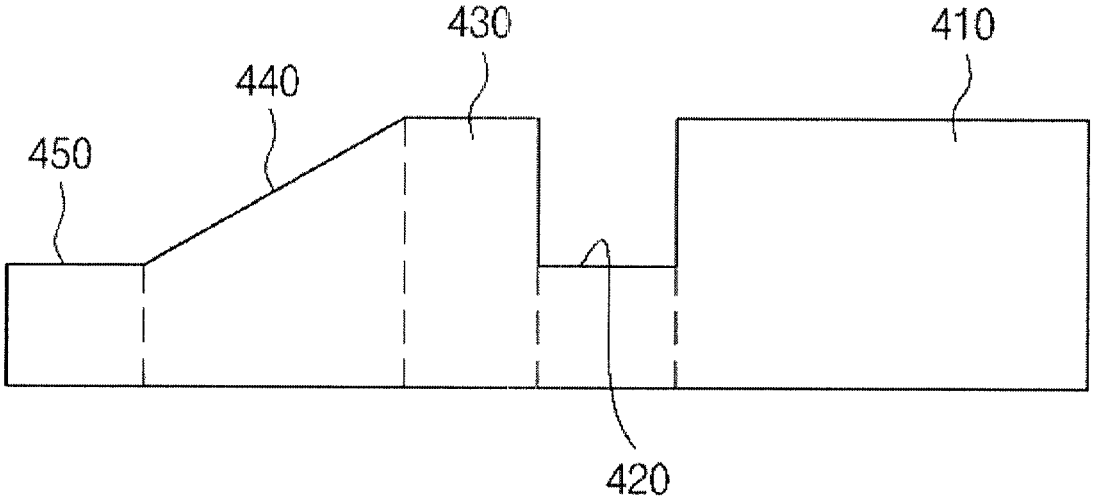
FIG. 4 is a cross-sectional view illustrating a waveguide according to still another embodiment of this disclosure.

FIG. 4 is a cross-sectional view illustrating a waveguide according to still another embodiment of this disclosure.

Referring to FIG. 4, the waveguide includes another short portion 420 between a first tall portion 410 and a second tall portion 430. That is, the electromagnetic wave is rectified through the short portion perpendicularly decreasing in height, and a resonance effect of the electromagnetic wave is generated in the second tall portion 430.

Subsequently, the rear end of the second tall portion 430 is provided with a tapered portion 440, and the electromagnetic wave subjected to the resonance concentrates. The rear end of the tapered portion 440 is provided with a second short portion 450, and the electromagnetic wave reflected from the end and the electromagnetic wave concentrating through the tapered portion concentrate at the short portion.

Therefore, the plasma generating region (point) of the atmospheric plasma equipment according to this disclosure is a region including all or at least a part of the short portion finally provided at the waveguide with the step. Accordingly, the generated plasma may be stably maintained even if there is a change in flow rate of a process gas.

In this manner, the step may be realized by the tapered structure of which a portion with a predetermined length decreases in height by a predetermined angle or the structure which perpendicularly decreases in height, and the electromagnetic wave passing through at least the first step enters a region with a larger volume than that of the first step. This disclosure further includes one or more steps, and any waveguide in which plasma is generated from the final short portion is included in the scope of the claims of this disclosure.

Figure 5:
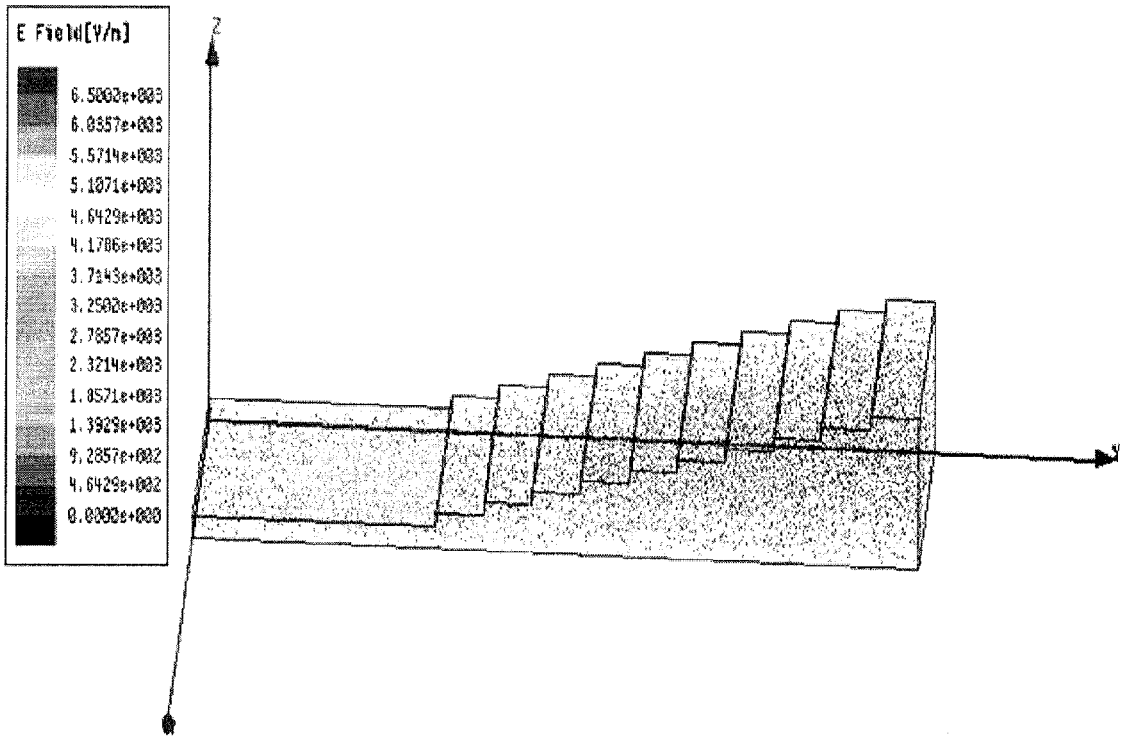
FIG. 5 illustrates a test result of the waveguide according to one embodiment of this disclosure.
Figure 6:
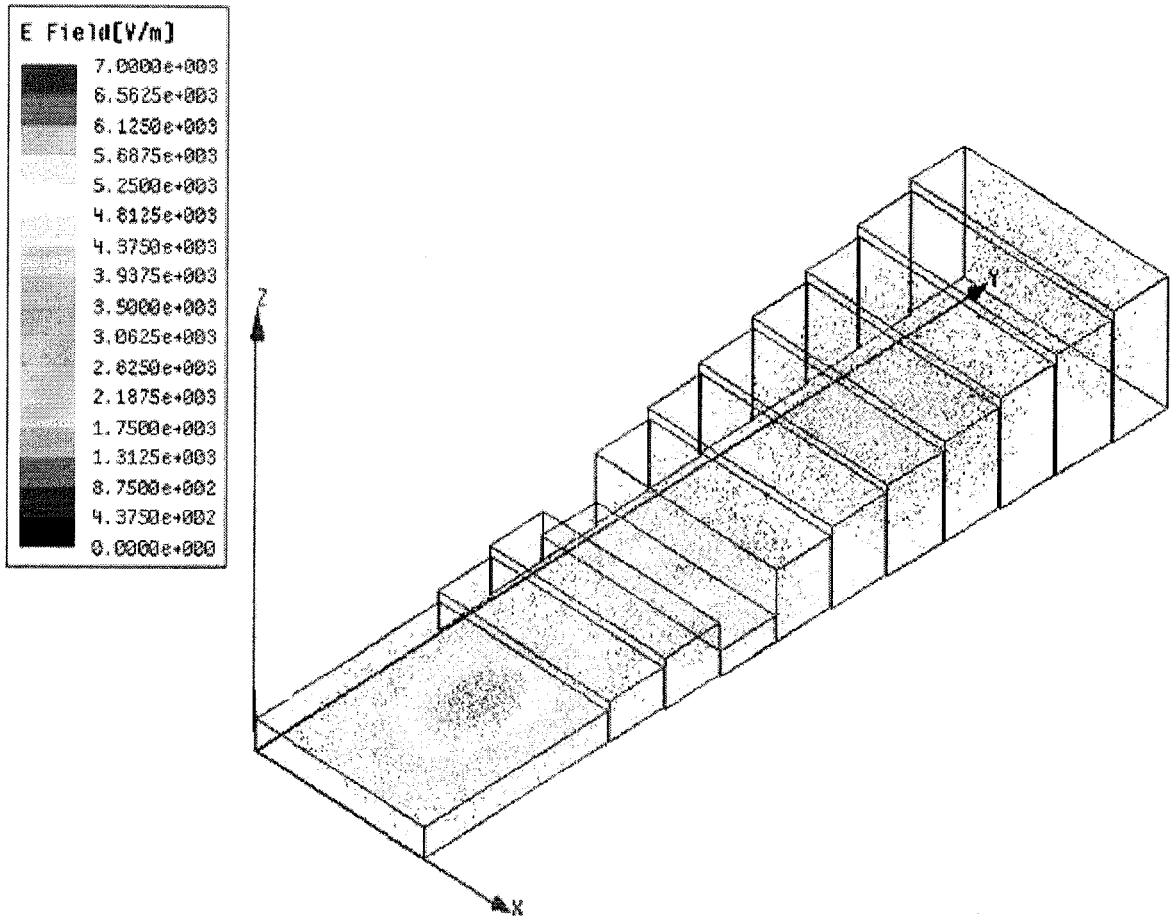
FIG. 6 illustrates a test result of the waveguide of which the height simply and continuously decreases.

FIG. 5 illustrates a test result of the waveguide according to one embodiment of this disclosure, and FIG. 6 illustrates a test result of the waveguide of which the height simply and continuously decreases.

Referring to FIGS. 5 and 6, it is found that the magnitude (corresponding to E-filed of the drawing) of the plasma generated at the end (that is, the tapered portion including the short portion) of the waveguide including one or more steps according to this disclosure is much greater than that of the waveguide of which the height continuously decreases without any step according to the related art (red or dark color in FIG. 6).

The atmospheric plasma equipment according to this disclosure may simultaneously attain an effect of causing concentration of an electromagnetic wave applied through the waveguide with one or more steps and an effect of stably maintaining generated plasma.

While the present disclosure has been described with respect to the specific embodiments, it will be apparent to those skilled in the art that various changes and modifications may be made without departing from the spirit and scope of this disclosure as defined in the following claims.

What is claimed is:

1. An atmospheric plasma equipment comprising:
an oscillator supplying an electromagnetic wave; and
a waveguide into which the electromagnetic wave generated from the oscillator is input to be propagated therethrough,
wherein the waveguide has a double tapered structure including
a first tall portion with a predetermined height,
a first tapered portion connected to an end of the first tall portion and decreasing in height by a predetermined angle,
a second tall portion connected to an end of the first tapered portion,
a second tapered portion connected to an end of the second tall portion and decreasing in height by a predetermined angle, and
a short portion connected to an end of the second tapered portion, and wherein plasma is generated at a waveguide region including the short portion.

2. The atmospheric plasma equipment according to claim 1, wherein the short portion decreases in height to have a tapered structure.

3. A waveguide for the atmospheric plasma equipment according to claim 2.

4. The atmospheric plasma equipment according to claim 1, wherein the waveguide region generating the plasma is includes the short portion and the second tapered portion.

5. A waveguide for the atmospheric plasma equipment according to claim 4.

6. The atmospheric plasma equipment according to claim 1, wherein the second tall portion is taller than the end of the first tapered portion.

7. A waveguide for the atmospheric plasma equipment according to claim 6.

8. The atmospheric plasma equipment according to claim 1, wherein the second tall portion has a predetermined length.

9. The atmospheric plasma equipment according to claim 8, wherein the predetermined length of the second tall portion is 0.

10. A waveguide for the atmospheric plasma equipment according to claim 9.

11. A waveguide for the atmospheric plasma equipment according to claim 8.

12. A waveguide for the atmospheric plasma equipment according to claim 1.

13. A atmospheric plasma equipment comprising:
an oscillator supplying an electromagnetic wave; and
a waveguide into which the electromagnetic wave generated from the oscillator is input to be propagated therethrough,
wherein the waveguide has a double tapered structure including
a first tall portion with a predetermined height,
a first tapered portion connected to an end of the first tall portion and perpendicularly decreasing in height,
a second tall portion connected to an end of the first tapered portion,
a second tapered portion connected to an end of the second tall portion and decreasing in height by a predetermined angle, and
a short portion connected to an end of the second tapered portion, and wherein plasma is generated at a waveguide region including the short portion.

14. A waveguide for the atmospheric plasma equipment according to claim 13.

* * * * *